United States Patent [19]

Follety, Jr.

[11] Patent Number: 4,948,135

[45] Date of Patent: Aug. 14, 1990

[54] BASEBALL GAME

[76] Inventor: Philip A. Follety, Jr., 144 Crescent Ave., Waldwick, N.J. 07463

[21] Appl. No.: 312,623

[22] Filed: Feb. 17, 1989

[51] Int. Cl.[5] ..... A63F 7/20

[52] U.S. Cl. ..... 273/90; 273/88; 273/127 B

[58] Field of Search ..... 273/88–90, 273/127 B, 123 R, 177 B, 398, 400, 404

[56] References Cited

U.S. PATENT DOCUMENTS

| | | | |
|---|---|---|---|
| 487,825 | 12/1892 | Curtis et al. | 273/89 |
| 861,841 | 7/1907 | Heitmann | 273/89 |
| 968,366 | 8/1910 | Krug | 273/88 |
| 998,424 | 7/1911 | Stevenson | 273/93 R |
| 1,008,898 | 11/1911 | Fulton et al. | 273/89 |
| 1,060,846 | 5/1913 | Krumeich | 273/89 |
| 1,296,882 | 3/1919 | Vance | 273/89 |
| 1,642,093 | 9/1927 | Stewart | 273/89 |
| 2,251,724 | 8/1941 | Vogel | 273/90 |
| 2,462,170 | 2/1949 | Dube | 273/90 |
| 2,775,457 | 12/1956 | Galbos | 273/120 R X |
| 2,802,667 | 8/1957 | Bertley | 273/89 |
| 2,980,427 | 4/1961 | Cragg | 273/90 |
| 3,009,452 | 11/1961 | Barber et al. | 273/89 |
| 3,705,723 | 12/1972 | Eissler | 273/89 |
| 4,017,074 | 4/1977 | Roberts | 273/89 |
| 4,261,569 | 4/1981 | Frohlich | 273/93 R |
| 4,602,786 | 7/1986 | Valentino | 273/90 |
| 4,715,603 | 12/1987 | Gleason | 273/90 |

*Primary Examiner*—Edward M. Coven

*Assistant Examiner*—Sebastiano Passaniti

*Attorney, Agent, or Firm*—W. Patrick Quast

[57] ABSTRACT

A baseball game for playing on a flat support in miniature fashion is provided. The baseball game includes a field such as indoor outdoor carpet or the like, having marked thereon an outfield area and an infield area and a pitcher mound area and a base runner area. The field also has a first base area, a second base area, a third base area and a home base area. The game also includes outfield fence portions each made of a relatively rigid sheet including adjacent flexible portions, four infielder pieces and three outfielder pieces. Each fielder piece has an upright wall member formed from a transparent flexible sheet of plastic material having opposite end portions with respective wall openings, and an elongate cloth strip having opposite end strip portions respectively received in the opposite wall openings and connecting to the opposite wall portions. The game also includes a triple area marker, disposed next to a fence portion at the deepest part of the field, a base runner disk having a visitor player picture card attached to one face thereof and having a home player picture card attached to the opposite face thereof, two elongate barrier cloth ribbons disposed between each pair of adjacent outfielder pieces and connecting thereto, a ball and bat, which can be held in the opposite hands of a sole game player, a backstop fence, and a catcher box, which has one wall having an "X" marked thereon facing the infield area.

7 Claims, 4 Drawing Sheets

56
92
90
88
Home At Bat 38
54
112
104
106
116
122
108
118
120
114
52
110

38
54
115
104
106
108
114
52

26
42
94
86
44
12
84
46

BASEBALL GAME

The invention relates to a baseball game, and in particular the invention relates to a baseball game having fielder pieces with ball restraining members.

BACKGROUND OF THE INVENTION

The prior art baseball game is shown and described in U.S. Pat. No.:

4,602,786 issued Jul. 29, 1986, of Valentino. Related patents include U.S. Pat. Nos.:
4,715,603, issued Dec. 29, 1987 of Gleason,
2,980,427, issued Apr. 18, 1961, of Cragg,
2,462,170, issued Feb. 22, 1949, of Dube,
2,251,724, issued Aug. 5, 1941, of Vogel,
1,276,777, issued Aug. 27, 1918, of Lewis,
1,110,117, issued Sept. 8, 1914, of Drennan,
944,504, issued Dec. 28, 1909 of DeRocher, and
819,212, issued May 1, 1906 of Filer.

The prior art baseball game includes a field, outfield, fence portions, two foul line posts, four infielder pieces, three outfielder pieces, outfield barrier members, a backstop fence, a ball and a bat.

One problem with the prior art baseball game is that the outfielder pieces and infielder pieces, when hit by the ball, cause the ball to rebound back towards the backstop.

SUMMARY OF THE INVENTION

According to the present invention, a baseball game is provided. This baseball game comprises a field, outfield fence portions, two foul line posts, four infielder pieces, three outfielder pieces, outfield barrier members disposed between the outfielder pieces, a backstop fence, a ball, and a bat, wherein the outfielder pieces and infielder pieces have an impact absorbing tension member for absorbing the force of the ball and for preventing rebound of the ball when the fielder piece is hit by the ball.

By using the force absorbing tension member, the problem of the outfielder pieces and infielder pieces, when hit by the ball, causing the ball to rebound towards the backstop is avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
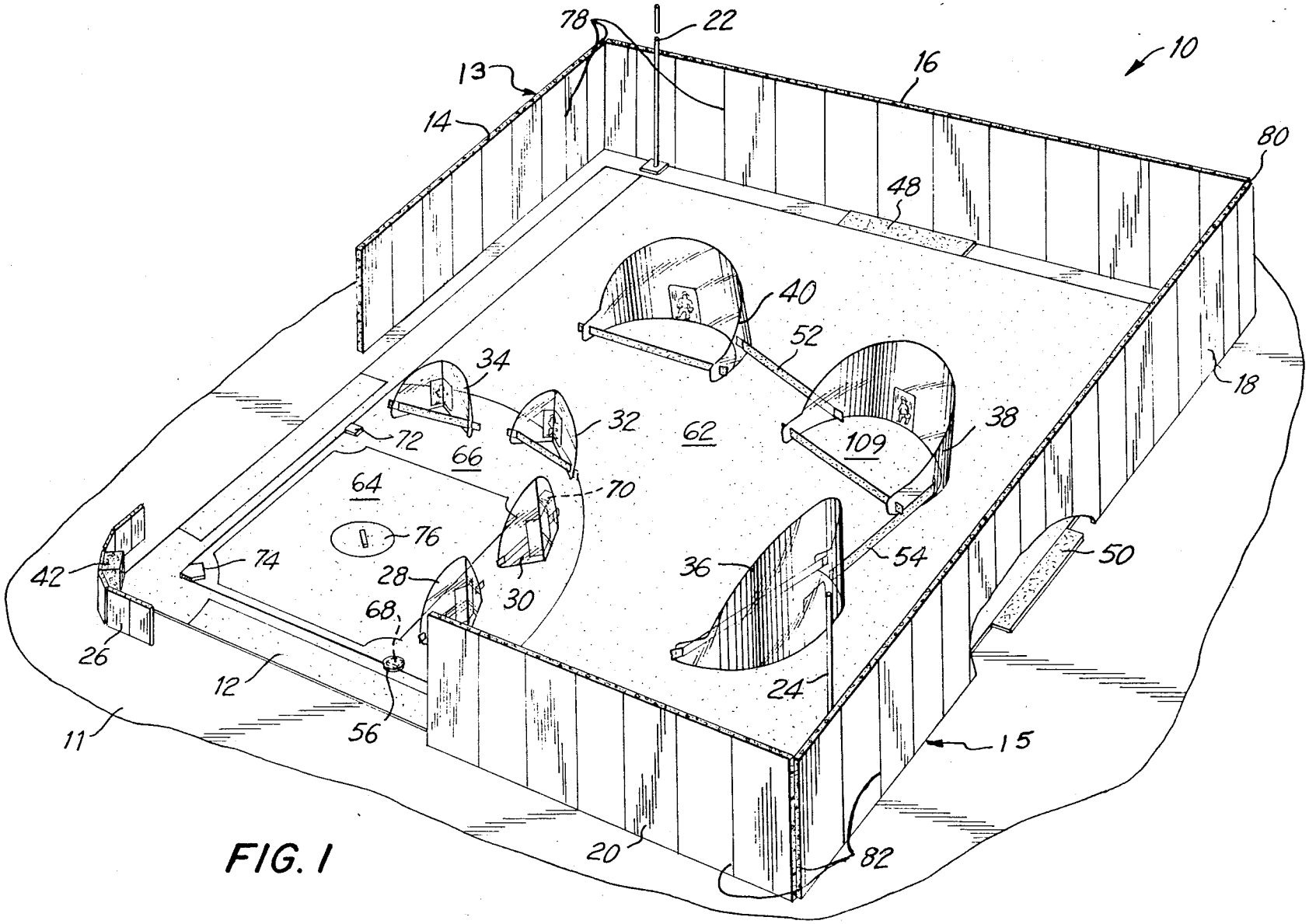
FIG. 1 is a perspective view of a baseball game according to the invention.
Figures 2, 3, 4, 5:
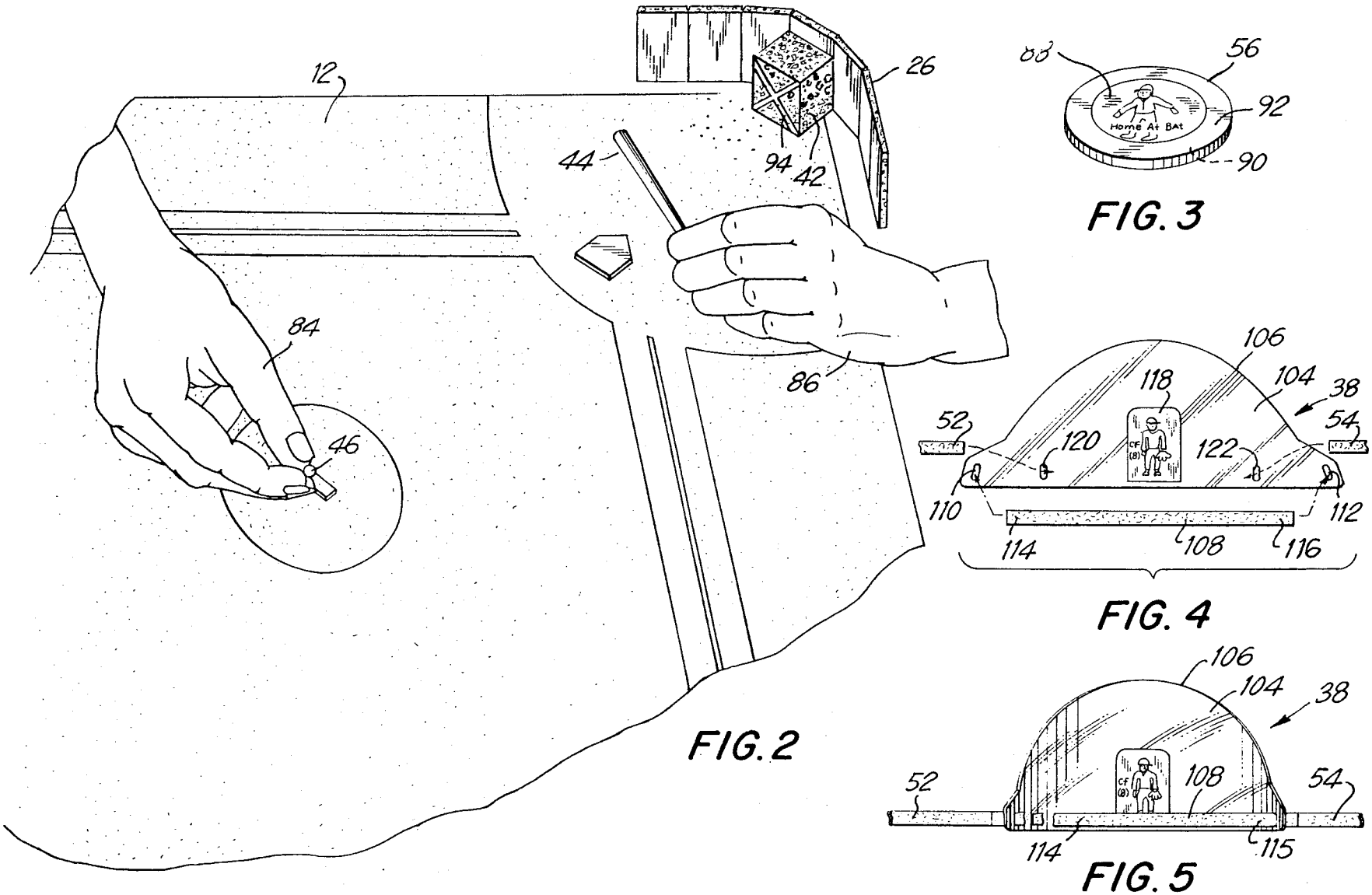
FIG. 2 is an enlarged perspective view of a portion of FIG. 1.
FIG. 3 is an enlarged perspective view of another portion of FIG. 1.
FIG. 4 is an enlarged, unassembled, portion of FIG. 1.
FIG. 5 is an enlarged, assembled, portion corresponding to FIG. 4.

As shown in FIGS. 1 and 2, a baseball game, as miniature baseball game 10 is provided. Game 10 rests on a support 11. Game 10 includes a baseboard or mat or field unit 12, two outfield wall sections 13 and 15 including portions 14, 16, 18, 20; two foul line posts 22, 24, and a backstop fence 26.

Game 10 also includes four infielder pieces or infield players 28, 30, 32, 34 and three outfielder pieces or outfield players 36, 38, 40. Game 10 also includes a catcher piece or catcher 42. Game 10 also includes a bat 44 and a ball 46. Bat 44 and ball 46 can be held or played by a single game operator or game player 47.

As shown in FIG. 1, game 20 also has "triple area" marker pieces or cloth pieces 48, 50, which are respectively located next to fence portions 16, 18.

Game 10 also has base hit barrier members or barrier members 52, 54. Barrier member 52 connects to and is disposed between outfielder pieces 38, 40. Barrier member 54 connects to and is disposed between outfielder pieces 36, 38.

Game 10 also has three, identical, base runner disks or markers or chips, like chip 56, which is shown in FIGS. 1 and 3.

Field unit 12 includes an outfield grass area 62, an infield grass area 64 and a dirt area 66. Field unit 12 also has a first base area or portion 68, a second base area 70, a third base area 72, and a home base area 74. Base areas 68, 70, 72, 74 are spaced apart and surrounded by dirt area 66, which is a diamond shaped dirt area. Field unit 12 also has a pitcher mound area 76, which is a relatively small area, that is surrounded by infield grass area 64. In this embodiment, field unit 12 is a green mat, e.g. indoor/outdoor carpet. Dirt areas such as 66, 76, are provided by painting the mat at these locations with brown paint. Base portions 68, 70, 72, 74 can be delineated by separate pieces cemented in place; or simply by painting the areas with white paint, or the like.

As shown in FIG. 1, outfield fence sections 13 and 15 have a plurality of crease lines, 78 and 82 which permit the fence to be positioned about the field in different configurations, e.g. FIG. 1 and FIGS. 9 thru 14. In FIG. 1, sections 13 and 15 are butted together in center field at juncture 80.

Figure 8:
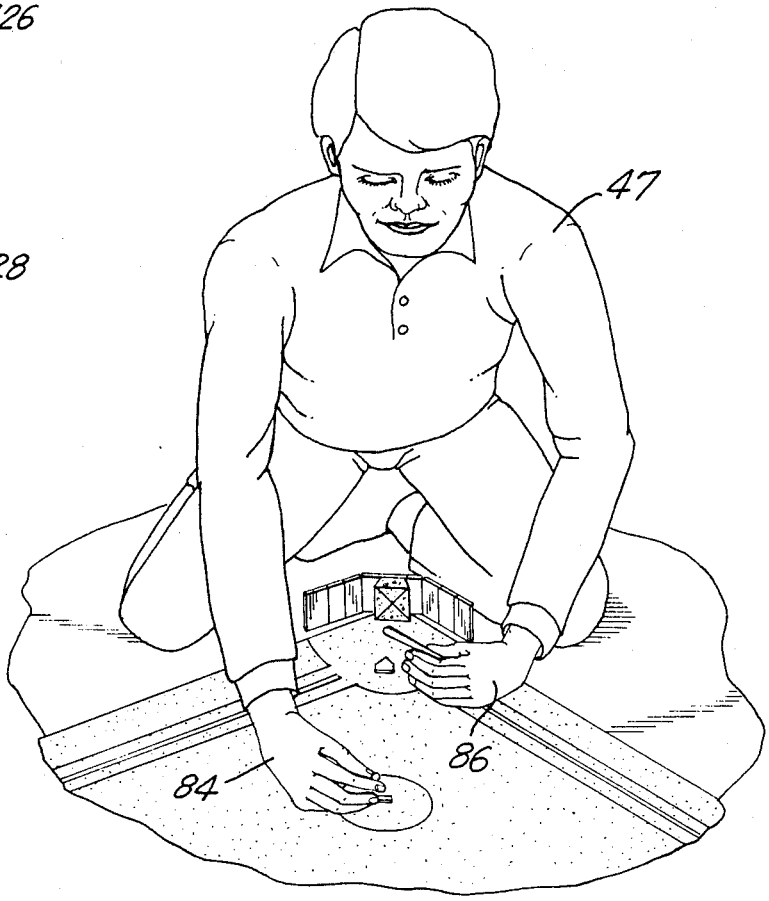
FIG. 8 is a perspective view of a player together with a portion of FIG. 1.

The sizes of field area 62, 64, 66, 76 and the sizes of fence portions 14, 16, 18, 20, 26 are made to a scale which is a reasonable scale for handling by a sole game operator 47. The sizes of bat 44 and ball 46 are sizes which are suitable for handling by the fingers and hands of operator 47, as shown in FIGS. 2 and 8. Operator 47 normally holds ball 46 in his right hand 84, and holds bat 44 in his left hand 86, or vice versa.

As shown in FIGS. 1 and 3, base running disk 56 rests on first base area 68, as explained hereafter. Disk 56, is one of three such disks, for representing a man on base. Disk 56, which is circular in shape, has circular picture cards 88. Disk 56 has opposite faces 90, 92, to each of which a card 88 is attached by adhesive or the like. The card picture on one side is a home player, and on the other side, a visiting player.

Catcher box 42 is a solid cube made of foam or the like, with an "X" marking 94 painted on the side which faces pitcher's mound 76. Catcher Box 42 is glued onto fence portion 26.

As shown in FIGS. 4 and 5, outfielder piece 38, which is identical to pieces 36, 40, except as noted below, has an arcuate transparent wall 104, which has a curved edge portion 106. Outfielder piece 38 also has a tension ribbon member, and resilient barrier, 108. Wall 104 has two end openings 110, 112. Ribbon 108 has two end portions 114, 116, which are respectively received in openings 110, 112, forming connections therewith. Outfielder piece 38 also has a picture card 118, attached to wall 104 by adhesive or the like, which portrays a fielder and designates his position and "number" as used traditionally by scorebook users. Wall 104 and ribbon 108 when positioned on the field enclose a space 109 (FIG. 1.).

Center outfielder piece 38 has left and right openings 120, 122, which respectively receive adjacent end portions of resilient barrier, ribbons 52, 54. As viewed from the pitcher's mound, left outfielder piece 40 has a corresponding right opening only; while right outfielder piece 36 has a corresponding left opening only.

Figure 6:
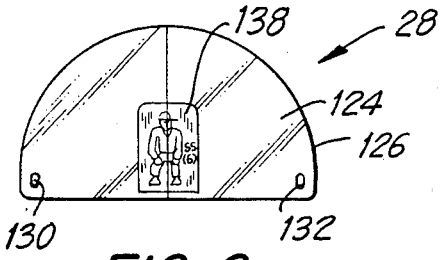
FIG. 6 is an enlarged, unassembled portion of FIG. 1.
Figure 7:
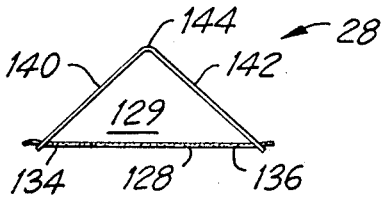
FIG. 7 is an enlarged, assembled, portion corresponding in plan view, to FIG. 6.

As shown in FIGS. 6 and 7, infielder piece 28, which is identical to infielder pieces 30, 32, 34, has an arcuate transparent wall 124. FIG. 6 is an unassembled elevation view of wall 124. FIG. 7 is an assembled plan view of infielder piece 28. Wall 124 has a curved upper edge 126. Infielder piece 28 also as a tension member or ribbon 128. Wall 124 has opposite end openings 130, 132; and resilient ribbon member 128 has opposite end portions 134, 136 which are received in openings 130, 132 for connecting thereto. Infielder piece 28 has a picture card 138 which is attached to wall 124. Wall 124 is a single piece of transparent material such as vinyl which is worked to form two wall portions, 140 and 142, about flex point 144.

Ribbon members 128 or 108, which typically are made from cloth are impact absorbing tension members. Wall portions 140, 142 apply end forces to ribbon 128. Ribbon 128 or 108 absorbs an impact force, applied normal or transverse thereto by ball 46. Wall 124 and ribbon 128 enclose a space 129. Ribbon 128 or 108 acts to prevent a rebound of ball 46 from its space 129 or 109.

Figure 9:
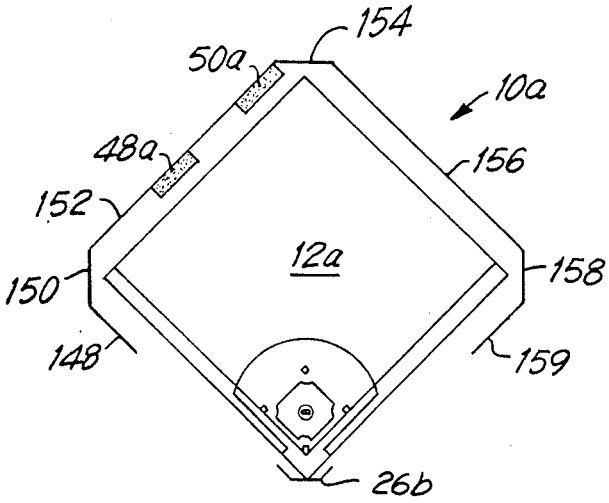
FIG. 9 is a second embodiment of the baseball game of FIG. 1.

In FIG. 9, a second embodiment of game **10*a* is shown. Parts of this embodiment 10*a*, which are the same as parts of first embodiment 10, have the same numerals, but with a subscript "a" added thereto. As explained hereafter, succeeding embodiments 10*b*, 10*c*, etc., have succeeding subscripts "b", "c", etc., in a like fashion. The various fence arrangements described are achieved by bending each of fence sections 13 and 15 at different crease lines 78 and 82**.

Game **10*a* includes a baseboard or field 12*a*, backstop fence 26*a*, and "triple area" cloth markers 48*a*, 50*a*. Game 10*a* also includes fence portions 148, 150, 152, 154, 156, 158, 159 which are disposed in a new arrangement around field 12*a*. Markers 48*a*, 50*a* are disposed next to fence portion 152**.

Figure 10:
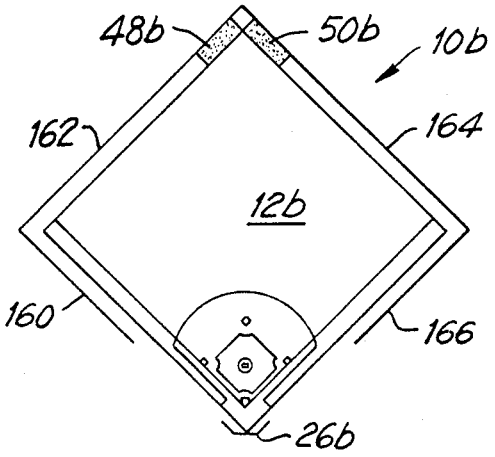
FIG. 10 is a third embodiment of the baseball game of FIG. 1.

In FIG. 10, new embodiment **10*b* includes field 12*b*, backstop fence 26*b*, and markers 48*b*, 50*b*. Game 10*b* also includes fence portions 160, 162, 164, 166. Markers 48*b*, 50*b* are respectively disposed next to fence portions 162, 164**.

Figure 11:
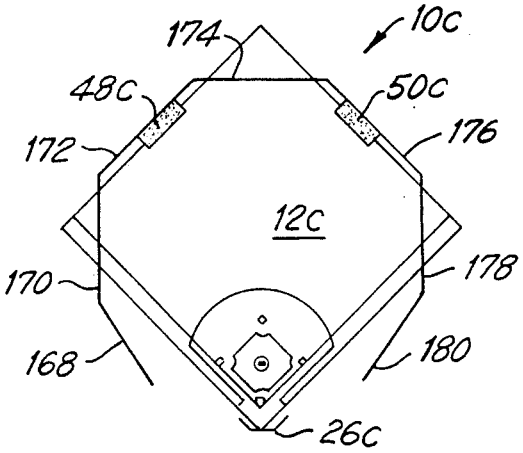
FIG. 11 is a fourth embodiment of the baseball game of FIG. 1.

In FIG. 11, new embodiment **10*c* includes field 12*c*, backstop fence 26*c* and markers 48*c*, 50*c*. Game 10*c* also includes fence portions 168, 170, 172, 174, 176, 178, 180. Markers 48*c*, 50*c* are respectively disposed next to fence portions 172, 176**.

Figure 12:
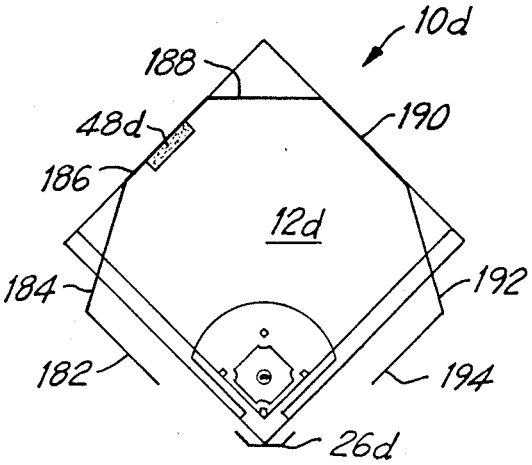
FIG. 12 is a fifth embodiment of the baseball game of FIG. 1.

In FIG. 12, new embodiment **10*d* includes field 12*d*, backstop fence 26*d*, and marker 48*d* only. Game 10*d* also includes fence portions 182, 184, 186, 188 190, 192, 194. Marker 48*d* only is disposed next to fence portion 186**.

Figure 13:
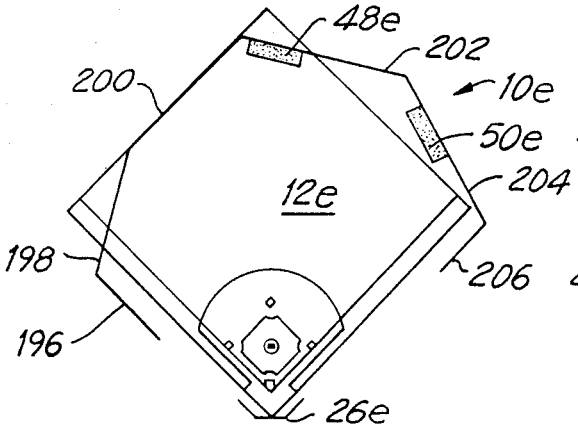
FIG. 13 is a sixth embodiment of the baseball game of FIG. 1.

In FIG. 13, new embodiment **10*e* includes field 12*e*, backstop fence 26*e*, and markers 48*e*, 50*e*. Game 10*e* also includes fence portions 196, 198, 200, 202, 204, 206. Markers 48*e*, 50*e* are disposed next to respective fence portions 202, 204**.

Figure 14:
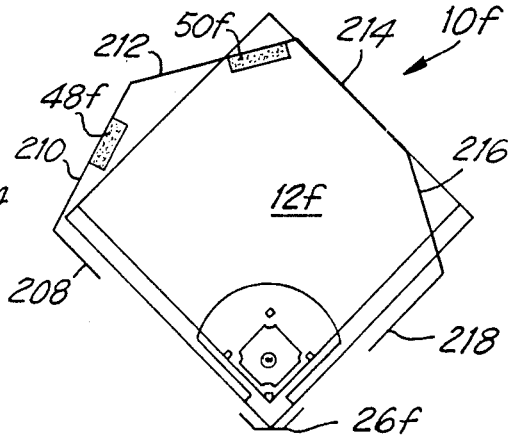
FIG. 14 is a seventh embodiment of the baseball game of FIG. 1.

In FIG. 14, new embodiment **10*f* includes field 12*f*, backstop fence 26*f*, and markers 48*f*, 50*f*. Game 10*f* also includes fence portions 208, 210, 212, 214, 216, 218. Markers 48*f*, 50*f* are disposed next to respective fenced portions 210, 212**.

In general, two markers, in all FIGS. except FIG. 12, are located on the deepest part of the field. In a small field, as in FIG. 12, one marker only is used.

The rules and manner of playing game 10 are indicated hereafter. First, the setting up of the field 12 and fielders is explained. Thereafter, instructions to a game player are given.

The Catcher (c)42: In this game, the "catcher" is the strike-zone piece 42 that is placed just behind the batter's area at home plate. If the "catcher" is too close to the batter, the piece 42 can be placed further back. The "catcher" keeps the ball on the field, so you don't have to be looking for it after every pitch that gets by the batter.

The First Baseman (1*b*)28: This piece is placed so that the player is facing toward home plate (the other fielding pieces are similarly positioned). Also, all the players are positioned totally in fair territory to make the most of their fielding ability. The first baseman can be positioned even with the bag or back near the edge of the infield, or be moved closer to the line (to guard against extra-base hits), or, if desired, farther away.

The Second Baseman (2*b*)30: This piece is placed to the right of second base, and to the left of the first baseman (viewing from home plate). He can be played in or out at either edge of the base-path, or anywhere in between. This player should be turned slightly so as to place him even with the top lines of the batter's box.

The Shortstop (ss) 32: This piece is placed to the left of second base (viewing from home plate) from the middle of the base-path to the outer edge (toward left field). It is also turned slightly so as to face him even with the top lines of the batter's box.

The Third Baseman (3*b*)34: Like the first baseman, this player can be right next to the line, and can be played in or back.

THE OUTFIELDERS

The Left Fielder (lf)40, Center Fielder (cf) 38, and Right Fielder (rf) 36 are placed at least 6" past the infield base paths on the outfield grass. They should also face home plate (like the infielders).

Base Hit Barrier 52, 54: The outfielders are connected by two special resilient cloth ribbons. These ribbons 52, 54, are straightened out to form a barrier so that any ball that rolls to them and is kept on the infield side is only a single or base hit. This barrier represents the "cut-off" capability and range of the outfielders. Any ball that gets through them or flies over them is an "extra-base hit" (double or triple).

THE HOME-VISITOR RUNNER MARKERS

There are three base runner markers (chips) 56 to help remember who is on base. They show which team is at bat, which bases are occupied, and whether the runner or runners are "leading" or "holding" on base. The game can be played with the pieces or with "imaginary men".

THE GROUND RULES—FAIR TERRITORY, FOUL TERRITORY, AND OUT OF PLAY

Fair Territory: This is the area of the playing field between the foul lines (including the foul lines, and home plate) and extends to the foul poles 22, 24, (to be placed on line behind the foul lines and attached to the outfield wall.)

Foul Territory: This is the area which lies outside of the area above.

Out-of-Play: This is the area off of the playing field as defined by the playing surface provided or where the walls are placed. If a ball is hit so it lands out-of-play in foul territory, it is a foul ball—it is not playable.

If a ball is hit over the wall in fair territory it is out-of-play (unplayable)—it's a home-run!

If a ball rolls out-of-play after hitting a wall in fair territory, the batter gets a double and any runner on base advances 2 bases.

Ground Rule Double: Any ball that bounces over the wall in fair territory is a ground-rule double—the batter goes to second base and all the runners that were on base, advance 2 bases.

THE PITCHER AND THE BATTER

There are no playing pieces for the Pitcher or the batter in this miniature baseball game.

HOW TO PITCH AND BAT

The player positions himself by kneeling behind home plate for a sportscaster's view of the diamond, (see FIG. 8). He stays behind the home plate area, except when he has to go after a ball hit into the outfield or over the fence.

PITCHING (see FIGS. 2 and 8)

With either hand, the player takes a miniature baseball and holds it between his index finger (pointer) and thumb. His other three fingers are placed on the rubber (the white marker on the pitcher's mound).

The Pitching Motion: From this point the player starts his pitching motion (he can take his hand off of the mound to finish the motion, but he always starts there). The hand is moved back for added strength and, in a slinging motion, the ball is thrown towards home plate.

The ball should always be thrown with enough force to roll or go past home plate. (Any pitch not reaching home plate and not swung at is considered a ball.

THE STRIKE ZONE

The strike zone is the width of home plate and from the surface level to the first joint of the batting hand's index finger (see FIG. 2).

A pitch is a STRIKE if:

the batter swings and misses the ball;

the ball hits the "strike-zone" or "X" area of the catching piece, whether or not the batter swings at it;

the ball does not hit the piece, but still rolls or passes over the plate within the strike zone, whether or not the batter swings at it.

the ball is hit into foul territory with less than two strikes on the batter;

the ball is bunted foul—if bunted foul on the third strike, the batter is out.

THREE STRIKES AND "YOU'RE OUT!"

A pitch is a BALL, if:

the ball misses home plate or the strike zone, and the batter doesn't swing;

the ball doesn't reach home plate;

the batter swings, but the pitch hits the batting hand;

the batter swings, but the pitch is so far outside that it passes over the middle or outside of the empty batter's box.

If the ball goes past or over the backstop, it is a wild pitch and any runner advances one base.

BATTING

The miniature bat is picked up in the same way the player picks up the miniature baseball. It is held like a crayon or pencil between the index finger and thumb. The other fingers are used for support. The bottom of the other fingers are positioned on the right side of home plate for the right hand, and on the left side of home plate for the left hand.

SWINGING THE BAT

If the batter is a "righty", he places his right hand in the batter's box on the right side of home plate. If he is "lefty", he places his left hand to the left side of the plate. The motion for sWinging the bat is to start by bringing the hand forward and around so that the bat moves quickly across home plate.

The hand is kept in contact with the playing field. The batter can swing the bat on the surface to use it as support; or hold the bat off of the surface for different hitting effects. Of course, the swing must be timed to the release of the ball by the other hand.

BUNTING

Rather than taking a full swing, the player can try to bunt to move the runners over by holding the bat out when the ball is pitched. For more control, the player can slide his index finger to the top of the bat and hold it in front of home plate.

For purposes of the game, a safe bunt (base hit) must drop or roll (and stop) on the following areas:

1. The base paths from home plate to first base or from third base to home plate up to, BUT NOT ON, the rounded dirt areas around first base and third base. If the ball rolls to the dirt areas around the bases, it is assumed that the first baseman or third baseman can make the play. The batter is out.

2. The infield grass next to these base paths up to the invisible line from the top of the rounded dirt areas of first or third base to the middle of the rounded area round home plate.

3. The grassy area behind the pitcher's mound (past a line formed by the "tops" of first and third base).

A base hit is given to any batter who is able to hit the ball in these areas—whether he bunts the pitch, check swings, or hits it on the ground. Pop-ups are playable as outs.

A ball that hits 1st or 3rd base, and stays fair or goes foul without touching an infielder is also a base hit.

PLAYING INFIELDERS "IN"

If the infielders are playing "in" (even with the bag—1st or 3rd base) or closer—there is no base hit on a bunt. But if the ball gets past the players, even if it lands on the large base paths between 1st base to 3rd base—it's a base hit!

A REGULATION GAME

A Regulation Game is nine innings long. The visiting team has "first ups" and bats in the top of every inning. The home team is up last and bats in the bottom of every inning. If the home team has more runs than the visiting team after the top of the ninth inning is played, the bottom of the ninth inning is not played.

HITS AND OUTS

A Batter gets a BASE HIT (or a SINGLE) if the ball is hit into fair territory and:

rolls between two infielders and goes past them into the outfield and doesn't reach the outfielder;

rolls to an outfielder or hits the outfielder on a bounce;

is trapped or held inside the field ribbons 52 and 54 on a fly ball or grounder;

stops either in the "grassy" area behind the pitcher's mound (past a line formed by the "tops" of first and third base), or in fair territory along the foul lines between home and first or third.

ERRORS

The batter gets to first base on an "error" if the ball:

is hit on a grounder to an infielder, hits the infielder and rolls past or behind the fielder into the outfield.

is popped up in fair territory and is not caught either by the pitcher (pitching hand) or the catcher (catching hand).

DOUBLE

The batter gets a 2-base hit, a "2-bagger" or a double if the ball is hit into fair territory and:

bounces or flies past or behind the outfielders and past the barriers 52, 54;

hits the walls and rolls around the field behind the outfielders and the barriers, 52 54 (it does not matter if the ball ends up in foul territory, as long as it hits in fair territory first.);

bounces over the fence (Ground-rule double).

TRIPLE

The batter gets a 3-base hit, a "3-bagger" or a triple if the ball is hit into fair territory and:

rolls or flies onto the brown "triple area" cloth pieces 48, 50 placed in the deepest parts of the outfield past the grass area to the wall and remains there.

HOMERUN

The batter gets a home-run or a "homer" or a "4-bagger" if the ball is hit on a fly in fair territory and:

it goes over the fence.

OUTS

The batter is out if he:

strikes out by getting three strikes (a foul ball counts as a strike if there are less than two strikes). He can either strike out by swinging and missing a third strike, or by not swinging ("looking") at a good pitch thrown and hitting the strike zone area of the catching piece or rolling or passing over home plate.

has two strikes and he bunts foul, or he fails to swing at a pitch that passes through the "strike zone"

hits a ball (a line drive, a fly ball or a grounder) that is stopped, is touched, or bounces off an infielder and remains in the infield or hits an infielder and bounces into foul territory.

hits a "fly ball" that hits an outfielder or lands within the outfielder's fielding area or pocket 109. As long as a ball touches the outfielder on a fly, the batter is out.

hits a ball that rolls onto and stops on the base paths between first and third base. The play is made by the infielder piece closest to the ball, who "throws" it to first base.

hits an infield pop-up that is caught by the pitcher (pitching hand) or caught by the catcher (batting hand).

hits an infield pop-up or fly with a running on first and less than two outs (batter is out whether the ball is caught or not)—"the Infield Fly Rule"

hits a ball to that remains in front of or is trapped by infielders playing "in" (if the ball passes these infielders, it's a base hit even if it stays onthebase paths).

DOUBLE PLAYS

A batter hits into a double-play, or a "twin-killing", when:

the ball is caught or trapped by an infielder and there is a runner on first. The ball must be touching or held in the infielder's "trap" or "pocket". It is assumed that the infielder makes the play to second base, then to first base for two outs.

when the ball is hit on a line drive to an infielder at any base (the first baseman at first, the second baseman at second, or the third baseman at third) at which base the runner is "leading" or not touching the base.

OTHER OPTIONAL RULES

THE SACRIFICE FLY—A sacrifice is a play when there's less than two (2) outs and the batter hits into an out, but moves the runner on second or third base up or drives in a run.

A runner can advance one base on a fly out if there are less than two outs and:

a runner is on third base, and any outfielder makes the play. The ball hits the outfielder, but escapes, or gets out of, the player's pocket. The runner scores.

a runner is on second base, and the rightfielder makes the play. The ball hits the rightfielder, but escapes, or gets out of, the fielder's playing area (pocket). The runner advances to third.

This rule does not apply if the outfielder making the play is playing in (much closer to the infielders than to the wall). In this case, it is assumed that the outfielder that plays in can make the throw. "The runners hold."

"THE HIT AND RUN"—a runner on first or second can advance two bases on a single or three bases on a double, if he is positioned off the base he is on ("leading"). But, watch out! If a line drive is hit to any infielder closest to the base, the runner and batter are out. DOUBLE PLAY! If the runner stayed on the base (touching the base), only the batter would be out.

The advantages of game 10, and of the other embodiments are indicated hereafter:;

1. The Fielders: Three outfield pieces 36, 38, 40 of bowed vinyl, and four infield pieces 28, 30, 32, 34 of folded vinyl stop or impede the trajectory of ground, line-drive, or fly balls, with slots or holes 110, 112, and 130, 132 designed to accept and hold a cloth 108 and 128 or other impact-deadening material frontispiece to slow or stop the trajectory of ground balls to facilitate determination of hits and outs according to written rules of the game. Several functions of these players in determining sacrifice flies, double plays, and whether or not runners may advance, are also unique to the game.

2. The Outfield Walls: Walls 14, 16, 18, 20, are movable and bendable to form different stadium dimensions from the curved outfield of modern stadiums to smaller, more angular configurations of older ball parks. This ability to move the sections to form different ball park dimensions is functional—allowing the player or players to change the effort required to hit the ball out of the stadium, which according to the rules, is a home run in fair territory.

3. The Triple-Zone Markers: The rectangular cloth pieces 48, 50, allow the player to determine the deepest areas of the outfield, where the final stopping place of the ball represents a triple or three-base hit. Because the outfield walls are movable, these automatic zones have to also be movable to allow flexibility not found in other games of this type.

4. The Base Runner Disks: Disks 56 depict home and away players on reverse sides of the same disk in order to facilitate efficiency of play.

While the invention has been described in the preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A baseball game comprising:

a playing field having a relatively flat surface, including an outfield area and an infield area and having areas for a first base and a second base and a third base and a home base;

a ball for holding in the fingers of one hand of a game player so as to be pitched by that game player;

a bat for holding in the fingers of a game player so as to hit the pitched ball;

a plurality of outfield fence portions for engaging a ball hit by a bat;

a plurality of infield player pieces and outfield player pieces, disposed on said playing field, and representing, respectively, the first, second and third baseman, the shortstop, and the left, center and right fielder, wherein each said player piece comprises:

an upright wall member held in a fixed end position and including opposite end portions; and, a ribbon member having opposite end portions fixedly connected respectively to the wall opposite end portions, whereby a pocket is formed disposed towards home base, said ribbon member disposed nearer home base and said upright wall member disposed nearer said outfield fence portions, said ribbon member repelling a ball upon contact therewith, and absorbing its energy such that any ball hit into said pocket and subsequently contacting said ribbon member is more apt to be retained in said pocket; and, a pair of elongate barrier ribbon members, each said barrier ribbon member having opposite end portions, one of said barrier ribbon members fixedly connecting between the center fielder and the left fielder and the other of said barrier ribbon members fixedly connecting between the center fielder and the right fielder, each of said barrier ribbon members operable to repel a hit ball upon contact therewith.

2. The baseball game of claim 1 wherein the wall member is a transparent flexible sheet, and wherein each of the ribbon and elongate barrier ribbon members is a cloth strip.

3. The baseball game of claim 1, including a plurality of outfield fence portions partly enclosing the outfield area, wherein each said outfield fence portion is an upright, relatively rigid vertical sheet, and wherein at least one of said adjacent pairs of outfield fence portions includes a plurality of crease lines extending vertically the upright length of said fence portion whereby a plurality of upright panels, each between adjacent crease lines are formed, whereby each said creased outfield fence portion is bendable about each of said crease lines so as to be manipulatable to form different fence configurations such that different ballpark layouts are simulated.

4. The baseball game of claim 3, including at least one moveable marker for indicating a triple area which is disposed next to one of the outfield fence portions located in one of the deeper parts of the field.

5. The baseball game of claim 1, including at least one disk for placement on a base area, said disk having one face with a picture card with a home player picture and having an opposite face with a picture card with a visitor player picture, for indicating who is on base, and including a catcher piece having one wall with an "X" marked thereon facing the infield area.

6. The baseball game of claim 1, including:

two foul line posts disposed adjacent to two respective fence portions; and, a backstop fence disposed behind the homebase location.

7. A baseball game including:

a flat member having a surface, having an outfield area and an infield area and base locations;

a plurality of outfielder pieces and infielder pieces each said outfielder piece and infielder piece comprising:

an upright curved wall member having opposite end portions; and, restraining ribbon means having opposite end portions fixedly connecting respectively to the wall opposite end portions, whereby a pocket is formed disposed towards said base locations, said ribbon means disposed nearer said base locations and said wall member disposed away from said base locations, said ribbon means repelling a ball upon contact therewith, and absorbing its energy such that any ball hit into said pocket and subsequently contacting said ribbon means is more apt to be retained in said pocket.

* * * * *